US006840791B2

(12) United States Patent
Hsiu

(10) Patent No.: US 6,840,791 B2
(45) Date of Patent: Jan. 11, 2005

(54) SUPPORTING FRAME STRUCTURE CONFIGURED TO SUPPORT A PORTABLE ELECTRONIC DEVICE

(75) Inventor: Lee Jung Hsiu, Taipei (TW)

(73) Assignee: Lite-on Technology Corporation, Taipei (TW)

( * ) Notice: Subject to any disclaimer, the term of this patent is extended or adjusted under 35 U.S.C. 154(b) by 0 days.

(21) Appl. No.: 10/123,282

(22) Filed: Apr. 17, 2002

(65) Prior Publication Data

US 2003/0199187 A1 Oct. 23, 2003

(51) Int. Cl.[7] ..... H01R 13/64

(52) U.S. Cl. ..... 439/374; 439/929; 439/352; 439/31; 439/131; 439/165; 439/640; 320/112; 320/107

(58) Field of Search ..... 439/929, 352, 439/357, 372, 31, 131, 165, 640, 374; 320/112–115, 107–110

(56) References Cited

U.S. PATENT DOCUMENTS 5,619,397 A * 4/1997 Honda et al. ..... 361/686
5,691,618 A * 11/1997 Kobayashi et al. ..... 320/2
6,031,714 A * 2/2000 Ma ..... 361/681

* cited by examiner

*Primary Examiner*—Truc T. T. Nguyen
(74) *Attorney, Agent, or Firm*—Bacon & Thomas, PLLC

(57) ABSTRACT

A support frame structures for supporting a portable electronic device. The device includes a support frame and a lifting frame that are connected by hinges and supporting a revolving axis on a base. The supporting frame and the lifting frame are assembled onto the base, and are connected by the hinges. When the supporting frame rotates upwards and moves the hinges, and the hinges further move the lifting frame to slide along a sliding track groove to a fixed angle and secure the lifting frame and the supporting frame, which uplifts the supporting frame and allows the portable device to be placed on the base at an upright angle.

10 Claims, 7 Drawing Sheets

SUPPORTING FRAME STRUCTURE CONFIGURED TO SUPPORT A PORTABLE ELECTRONIC DEVICE

BACKGROUND OF THE INVENTION (1) Field of the Invention

This invention relates to a supporting frame structure, and more particularly to a base that is used to support a portable device assembled with a supporting frame. By the use of hinges of the supporting frame and a lifting frame as well as a sliding track groove on the base, the supporting frame can be easily lifted up by one single-direction movement to a fixed angle to complete the buildup and placement.

(2) Description of the Prior Art

Generally speaking, most traditional chargers use a concave trough at the bottom part to support the base of the recharging device. The concave trough is restricted by the external appearance and internal mechanisms to cause the device lack proper support during the recharging duration and can easily become loose, fall down, or have a bad connection if encounters an external force, which greatly compromises the intended function of the charger. Please refer to FIG. 1, a schematic structure view of a prior charger, which includes a base 1, and the base 1 further includes a concave trough at the bottom 2, where the concave trough at the bottom 2 is used to accommodate the recharging device. The base further includes a display unit 3 to inform user operation status during recharging.

As stated above, the device is placed in the concave trough at the bottom 2 during the actual recharging duration. Because of its improper design, the concave trough at the bottom 2 might not be able to provide enough support for the recharging device, a bad connection between the device and the charger might occur with a mere touch and interrupts the recharging task or even harms the circuit.

In addition, generally high-tech devices should avoid hitting and bumping. Other than the charger mentioned before, since portable devices are designed for convenient carrying, their structure designs have been strengthened. However, without proper handling, they can still be damaged by improper hitting and bumping. Take the example of PDA (Personal Digital Assistant), due to the continuous innovation of technology, its size gets smaller and smaller while the precision gets higher and higher, but design for device protection still lags behind.

In conclusion, the shortcomings of the prior art includes:

1. Lack of support and fixation function;
2. Unable to provide effective support during the recharging duration to fully utilize the recharge efficiency.

SUMMARY OF THE INVENTION

To improve the shortcomings of prior art, the present invention provides a supporting frame structure that is used to support a portable device and comprises a supporting frame, a lifting frame, a base and hinges coupling together, so the portable device can be securely placed on top of the base and not be damaged by negligence or external forces.

A supporting frame and a lifting frame are assembled on top of the base and hinges are used to secure the supporting frame and the lifting frame. When the supporting frame rotates upwards and moves hinges, the moving hinges then move the lifting frame to slide along the sliding track groove to a fixed angle and secure the lifting frame and the supporting frame onto the base.

Accordingly, it is a primary object of the present invention for the portable device to avoid external disturbances when placed on the base to fully utilize the base's operation efficiency, e.g., the recharging operation.

It is another object of the present invention to provide ease operation that can be built with a single action to allow a portable device to be securely placed.

It is a further object of the present invention to provide a supporting frame that is able to maintain the visual coherence of exterior design while not in use and also convenient storage.

BRIEF DESCRIPTION OF THE DRAWINGS

The present invention will now be specified with reference to its preferred embodiment illustrated in the drawings, in which.

DESCRIPTION OF THE PREFERRED EMBODIMENT

This invention disclosed herein is directed to a supporting frame structure. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
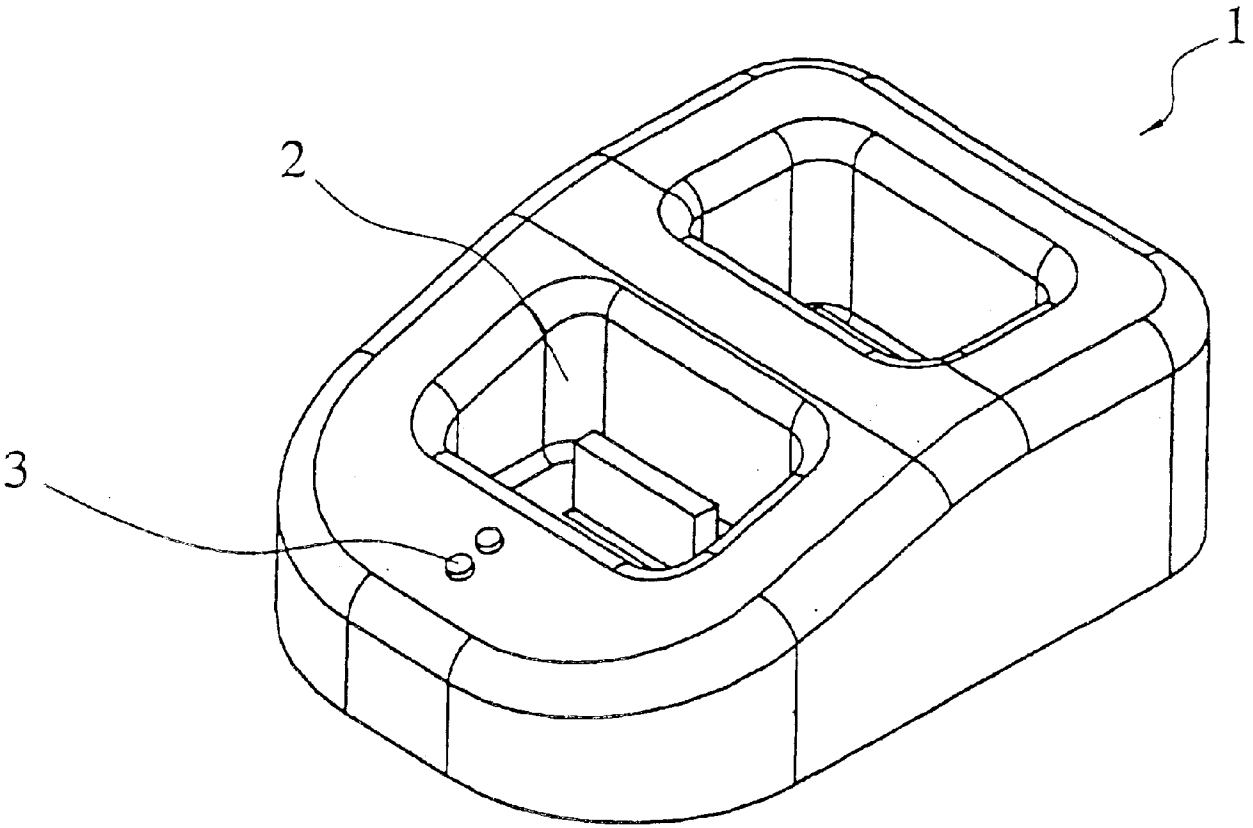
FIG.1 (PRIOR ART)
FIG. 1 is a schematic structure view of a prior charger.
Figure 2:
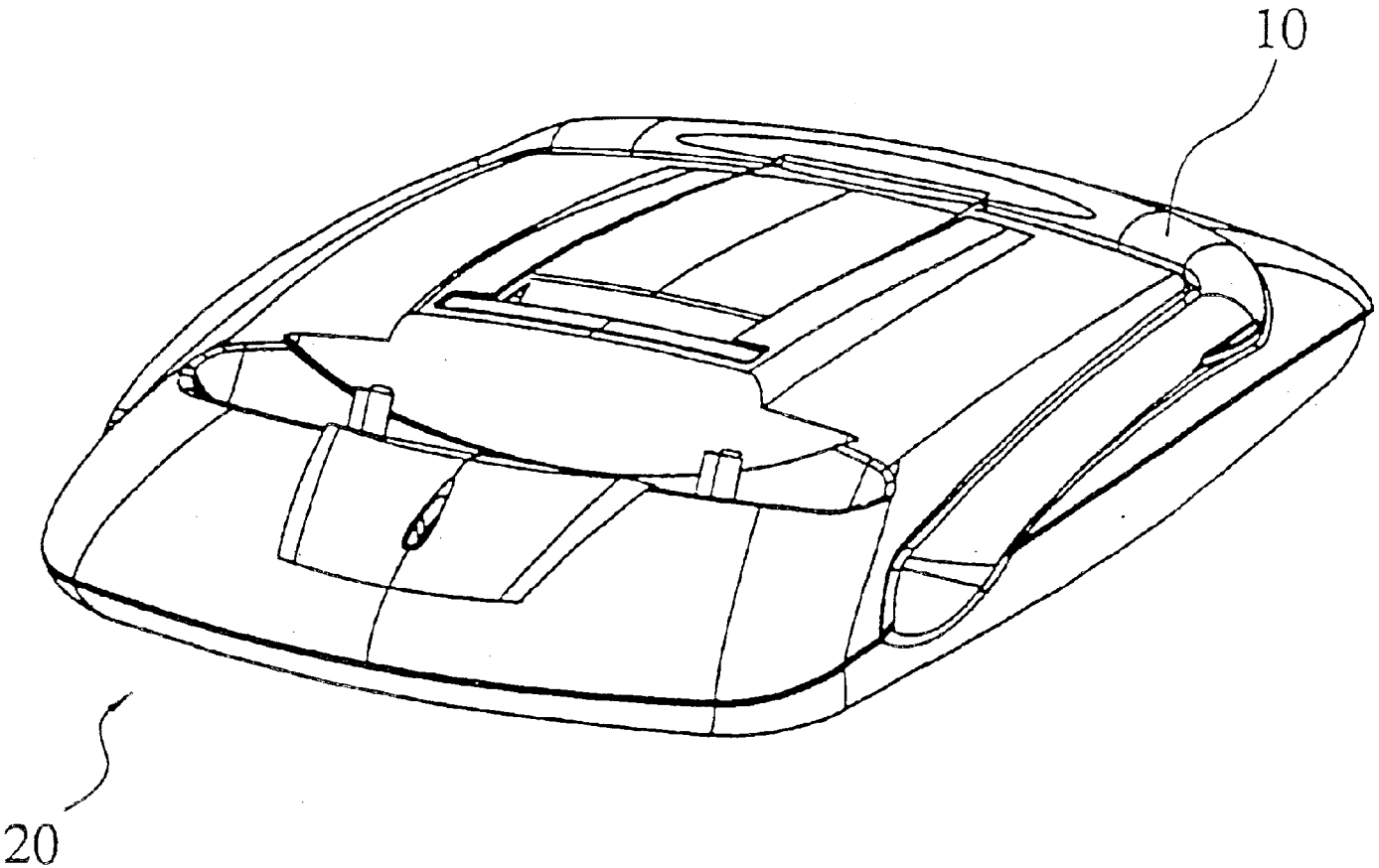
FIG. 2 is a schematic view of the external appearance of a preferred embodiment in accordance with the present invention.

Please refer to FIG. 2, a schematic structure view of a preferred embodiment in accordance with the invention, which is a supporting frame structure used to support a portable device. The structure shown in FIG. 2 comprises a supporting frame 10 and abase 20. The supporting frame 10 is connected to the base 20 by the use of hinges and revolving axis. With one single-direction movement, the supporting frame 10 can be lifted upwards to a fixed angle to complete the buildup and placement.

Figure 3:
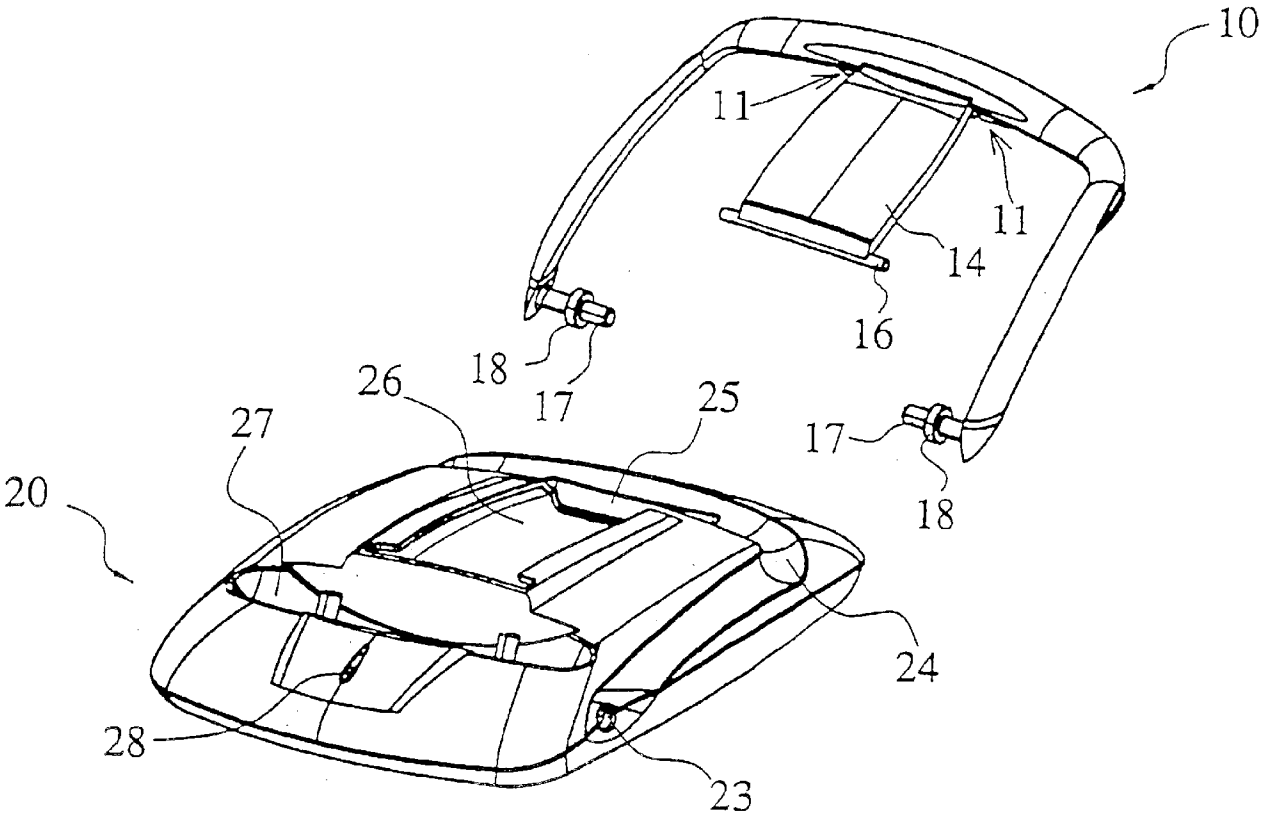
FIG. 3 is a schematic structure explosion view of a preferred embodiment in accordance with the present invention.

Please refer to FIG. 3, a schematic structure explosion view of a preferred embodiment in accordance with the invention, which allows a better understanding of the connecting relationship between the hinges and revolving axis of the supporting frame 10 and the base 20. The supporting frame 10 is a ⊓ shape frame and includes a pair of supporting revolving axis 17 at the front ends of its two arms. The supporting revolving axis 17 are placed into the matching supporting revolving axis holes 23 of the base 20 to fasten the supporting frame 10. The supporting revolving axis 17 further includes a revolving axis tenon 18 that is used to connect and fasten the supporting frame 10 and base 20.

By fastening the supporting revolving axis 17 onto the base 20, the supporting frame 10 can be lifted upwards by the user.

As shown in FIG. 3, the center of the supporting frame 10 is connected with a lifting frame 14 and on one end of the lifting frame 14 further includes a sliding pivot 16. The sliding pivot 16 is placed in a sliding track groove 26 on the base 20 to connect the supporting frame 10 and the lifting frame 14 with the base 20. Through the use of sliding track groove 26, the lifting frame 14 props up while the supporting frame 10 being lifted upwards, i.e., the supporting frame 10 is supported by the prop-up lifting frame 14. And after the sliding pivot 16 moves backwards to the end of the sliding track groove 26, the supporting frame 10 is supported upwards at a fixed position. The connecting relationship of the supporting frame 10 and the lifting frame 14 will be elaborated in detail in FIG. 4 and FIG. 5.

Besides of the supporting revolving axis holes 23 and the sliding track groove 26, the base 20 further includes a supporting frame storage groove 24 and a hinge storage groove 25, a storage trough 27 and a display unit 28, as shown in FIG. 3. The supporting frame storage groove 24 provides storage for the supporting frame 10 when it's not in use. It is able to maintain structure coherence, improve visual aesthetics, and be carried conveniently by allowing the supporting frame 10 to be stored in the supporting frame storage groove 24 during its idle state. In addition, since the connection between the lifting frame 14 and the supporting frame 10 is protruded out from the supporting frame 10, by the use of the hinge storage groove 25, the supporting frame 10 does not protrude out from the supporting frame storage groove 24 of the base 20 when it is not in use. The storage trough 27 is for placing user belongings and its size can vary depends on the intended portable object. The present invention is not limited for the use of potable electronic devices, like mobile phone or PDA (Personal Digital Assistant), but also can be used for other electronics communication devices or instruments, or even computer peripherals. The display unit 28 is used to inform user the operation status of the portable device, for example, when the base to be a charger, the display unit 28 is able to inform user the recharging status of the portable device.

Figure 4:
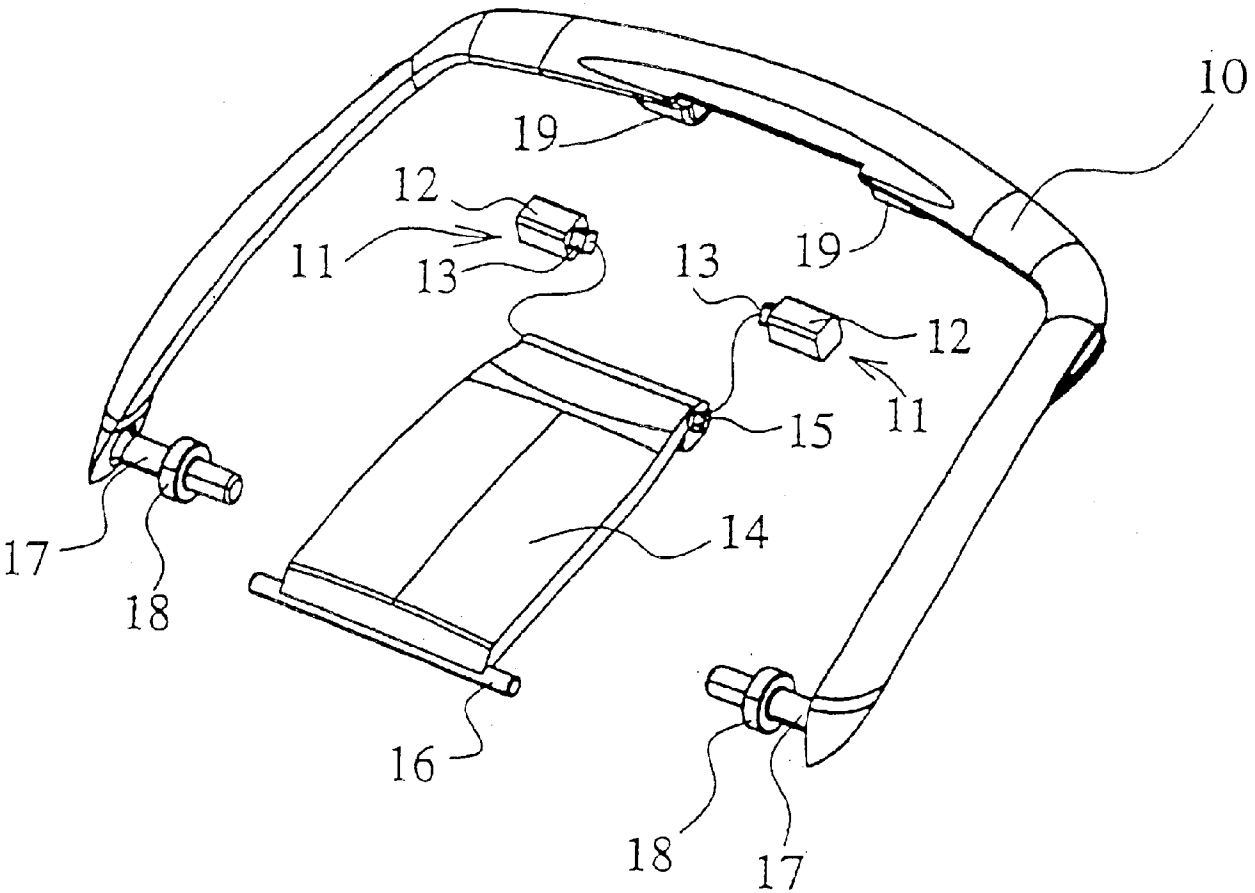
FIG. 4 is a schematic structure explosion view of a supporting frame in accordance with the present invention.

Please refer to FIG. 4, a schematic structure explosion view of the supporting frame 10 and the lifting frame 14 of a preferred embodiment in accordance with the present invention. As stated before, the supporting frame is a ⊓ shape structure and includes a supporting revolving axis 17 at each front end of its two arms, while the center of the supporting frame 10 is connected to the lifting frame 14. The detailed descriptions of the supporting revolving axis 17 and the lifting frame 14 have been stated with regard to FIG. 3 and won't be repeated. The description stated here is only for the connection between the supporting frame 10 and the lifting frame 14. As shown in FIG. 4, there is a hinge 12 at both ends of where the supporting frame 10 and the lifting frame 14 are connected, and the two hinges 12 are placed in the two hinge grooves 19 on the supporting frame 10. Each hinge 12 further includes a pivot 13 which is matched with a pivot fastening hole 15. The both pivot fastening holes 15 are mounted on both sides of the front end of the lifting frame 14, so the lifting frame 14 is placed at the center of the supporting frame 10 through the pivots 13, while the two hinges 12 become a hinge frame 11 and connect the lifting frame 14 and the supporting frame 10 to allow them to rotate a certain angle.

The hinges 12 shown in FIG. 4 allow the supporting frame 10 to spring back after being rotated to a certain angle, and different angles produce various strengths and directions of torques in order for the buildup and storage of the supporting frame 10. The hinge 12 used in the present invention is different from general door hinges. Ordinary hinges can only be used for the purpose of rotation and cannot spring back after being rotated to a certain angle. For example, the hinge used by the notebook screen cannot spring back after being rotated to a certain angle. The hinge used in the present invention is able to provide torque, so after the supporting frame 10 is lifted up to an angle, it only requires one hand to handle the lifting frame 14, so that the supporting frame 10 springs back immediately and retreats to the base 20, back to its idle state. And when the supporting frame 10 is lifted, the sliding pivot 16 of the lifting frame 14 can also be secured at the end of the sliding track groove 26.

Figure 5A:
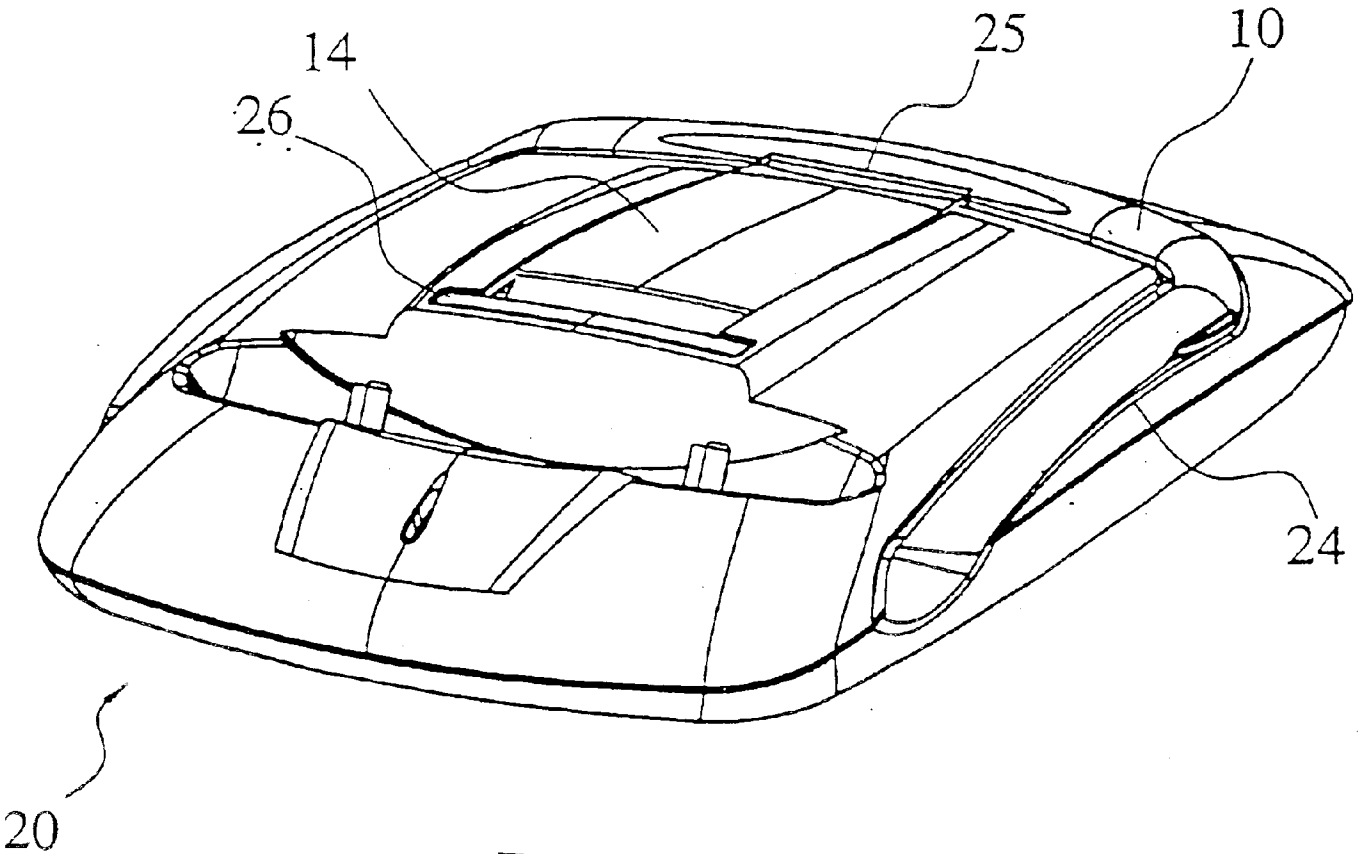
FIG. 5A is a first schematic view of a preferred embodiment in use in accordance with the present invention.
Figure 5B:
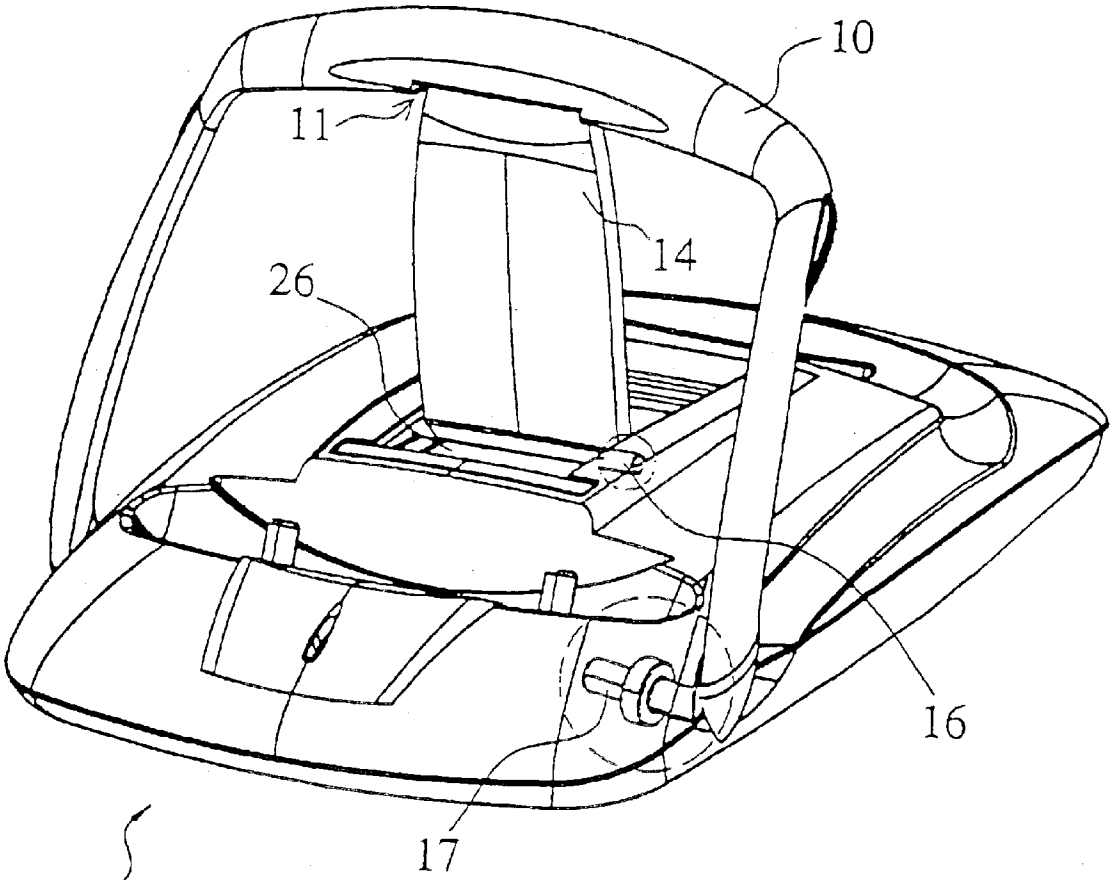
FIG. 5B is a second schematic view of a preferred embodiment in use in accordance with the present invention.
Figure 5C:
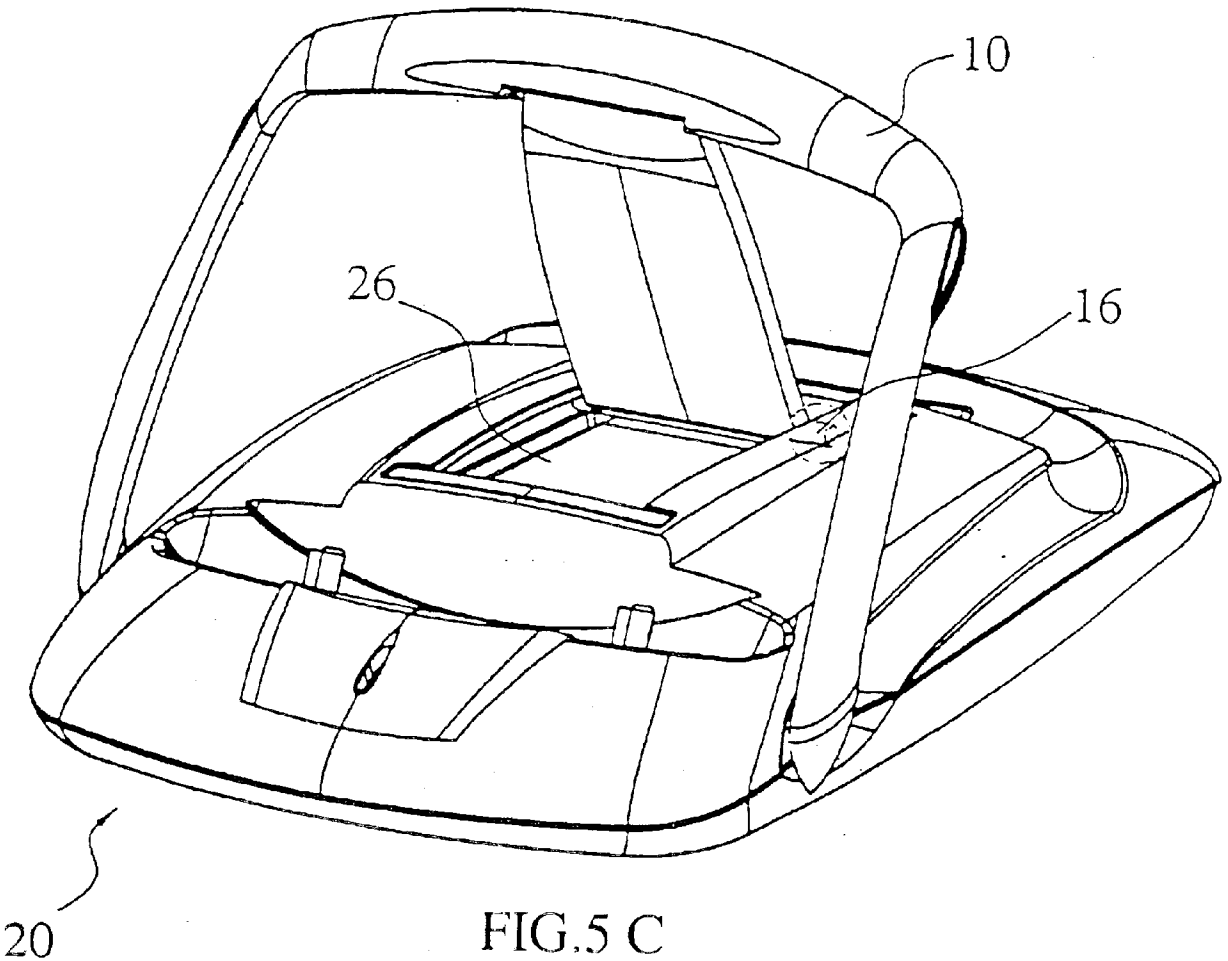
FIG. 5C is a third schematic view of a preferred embodiment in use in accordance with the present invention.

Please refer to FIG. 5A, a first schematic view of a preferred embodiment in use in accordance with the present invention. When the base is not in use, the supporting frame 10 is stored in the supporting frame storage groove 24 of the base 20, the hinge frame is also stored in the hinge storage groove 25, and the lifting frame 14 is placed flat in the sliding track groove 26, which allows to maintain the visual coherence of the structure. FIG. 5B is a second schematic view of a preferred embodiment in use in accordance with the present invention. As shown in FIG. 5B, the base 20 is in its active, state, where the supporting frame 10 is able to rotate upwards through the support of the supporting revolving axis 17. And the hinge frame 11 moves the lifting frame 14 and the sliding pivot 16 of the lifting frame 14, with the sliding pivot sliding along the sliding track groove 26 to the end of the sliding track groove 26, the supporting frame 10 and the lifting frame 14 forms an angle, as shown in FIG. 5C, a third schematic view of a preferred embodiment in use in accordance with the present invention. When the bottom of the lifting frame 14 is secured at the end of the sliding track groove 26, the supporting frame 10 is lifted upwards and secured at an angle for the user to place a portable object on top of the base 20.

The specification stated above uses the rechargeable devices like mobile phone or PDA as examples of a preferred embodiment. In fact, the structure of the present invention can also be used for other electronic communication devices and instruments or computer peripherals, to provide steady support for the electronic devices or computer peripherals. The only differences of the structure being used for various devices are the size and the placement method, and the structure can be used alone or in company with the base to provide steady support.

In conclusion, the advantages of the present invention may include:

1. Simple structure and can be easily assembled.
2. Easy operation, which only needs one single-direction movement to complete the buildup.
3. Convenient storage, which maintains the visual coherence of external appearance.

While the present invention has been particularly shown and described with reference to a preferred embodiment, it will be understood by those skilled in the art that various changes in form and detail may be without departing from the spirit and scope of the present invention.

I claim:

1. A supporting frame structure configured to support a portable electronic device, comprising:

a base comprising a pair of supporting revolving axis holes and a sliding track groove;

a supporting frame having two arms each including a supporting revolving axis at a front end thereof to be placed in a respective one of said supporting revolving axis holes;

a lifting frame connected with said supporting frame and including a sliding pivot at another end of said supporting frame and configured to be placed in said sliding track groove; and wherein said base further includes a supporting frame storage groove formed on an upper surface of said base, said supporting frame storage groove receives said supporting frame when said supporting frame is collapsed onto the upper surface of said base.

2. The supporting frame structure as claimed in claim 1, wherein said supporting revolving axis further includes a revolving axis tenon which is used to securely fasten in a respective one of said supporting revolving axis holes.

3. The supporting frame structure as claimed in claim 1, wherein at where said lifting frame connected with said supporting frame further includes a hinge frame.

4. The supporting frame structure as claimed in claim 3, wherein said hinge frame comprises a pair of hinges.

5. The supporting frame structure as claimed in claim 4, wherein each of said hinges includes a pivot.

6. The supporting frame structure as claimed in claim 4, wherein said hinges are placed in a pair of hinge grooves when said lifting frame is assembled with said supporting frame.

7. The supporting frame structure as claimed in claim 5, wherein said pivots are placed in a pair of pivot fastening holes.

8. The supporting frame structure as claimed in claim 1, wherein said supporting frame is lifted up and secured at an angle by the use of said lifting frame sliding in said sliding track groove.

9. The supporting frame structure as claimed in claim 1, wherein said base further includes a storage trough.

10. The supporting frame structure as claimed in claim 1, wherein said base further includes a display unit.

* * * * *

UNITED STATES PATENT AND TRADEMARK OFFICE

CERTIFICATE OF CORRECTION

PATENT NO. : 6,840,791 B2
APPLICATION NO. : 10/123282
DATED : January 11, 2005
INVENTOR(S) : Jung Hsiu Lee It is certified that error appears in the above-identified patent and that said Letters Patent is hereby corrected as shown below:

TITLE PG, ITEM (75) INVENTORS: The inventor's name should be listed as --Jung Hsiu Lee, Taipei (TW).--

TITLE PG, ITEM (12), Delete "Hsiu" and insert --Lee--,

Signed and Sealed this

Fourth Day of March, 2008

JON W. DUDAS
*Director of the United States Patent and Trademark Office*